US005271260A

United States Patent [19]

Oetlinger

[11] Patent Number: 5,271,260

[45] Date of Patent: Dec. 21, 1993

[54] BENDING DEVICE FOR FORMING CARTON BLANKING TOOLS

[75] Inventor: Frank Oetlinger, Greenfield, Wis.

[73] Assignee: Oetlinger Tool Engineering Co., Inc., Grafton, Wis.

[21] Appl. No.: 899,621

[22] Filed: Jun. 16, 1992

[51] Int. Cl.[5] ..... B21D 7/02

[52] U.S. Cl. ..... 72/388; 72/384; 72/387; 72/217

[58] Field of Search ..... 72/384, 387, 388, 308, 72/217, 218, 219

[56] References Cited

U.S. PATENT DOCUMENTS

| | | | |
|---|---|---|---|
| 654,373 | 7/1900 | Wikstrom | 72/388 |
| 1,042,112 | 10/1912 | Hartman | 72/388 |
| 4,526,025 | 7/1985 | Ritter et al. | 72/388 |
| 4,739,643 | 4/1988 | Kuriyama et al. | 72/384 |

FOREIGN PATENT DOCUMENTS

| | | | |
|---|---|---|---|
| 563077 | 6/1960 | Belgium | 72/388 |
| 515269 | 3/1921 | France | 72/217 |

*Primary Examiner*—David Jones
*Attorney, Agent, or Firm*—Andrus, Sceales, Starke & Sawall

[57] ABSTRACT

A bending device for forming a blanking tool of a die cutter used for cutting folding carton blanks. The bending device includes a support member defining a planar work surface, an axle member defining a longitudinal axis of rotation and orientated for rotation about said axis in a plane passing through said axis and perpendicular to said work surface, locator pins on said support member defining a plurality of bending stations and cooperable with said axle member to position said axle member at one of said bending stations during a bending operation; mounting arms for mounting said axle member on said support member to permit movement of said axle member to any one of said bending stations; and a roller mounted eccentrically at the lower end of said axle member and defining a bending axis parallel to and spaced from said rotational axis. When the axle member is positioned at a bending station and rotated a workpiece located between the roller and locator pin is bent to a desired angle.

7 Claims, 2 Drawing Sheets

BENDING DEVICE FOR FORMING CARTON BLANKING TOOLS

BACKGROUND OF THE INVENTION

The present invention relates to bending tools, and more particularly to a bending device for forming a blanking tool for a die cutter that cuts carton blanks in the folding carton industry.

Folding cartons are formed from a continuous sheet of cardboard material. This continuous sheet of cardboard material must be cut to the desired shape of the carton and then stacked for subsequent shipping and/or folding. In order to accomplish this, a blanking tool is employed in a die cutting operation which essentially stamps the desired shaped carton blank from the continuous sheet of cardboard material. The blanking tool used in such an operation must be precisely bent to match the shape of the desired carton blank.

Although various devices have been developed for manufacturing such blanking tools there remains a need for an improved device which is less costly yet just as precise.

SUMMARY OF THE INVENTION

A bending device for forming a blanking tool for a die cutter used to cut folding carton blanks. The bending device includes a support member defining a planner work surface; an axle member defining a longitudinal axis of rotation and orientated for rotation about said axis in a plane passing through said axis and perpendicular to said work surface; locator means on said support member defining a bending station and cooperable with said axle member to position said axle member at said bending station during a bending operation; mounting means for mounting said axle member on said support member to permit movement of said axle member to any one of said bending stations; and roller means mounted eccentrically at one end of said axle member and defining a bending axis parallel to and spaced from said rotational axis so that when said axle member is positioned at a bending station and rotated a workpiece located between said roller means and locator means is bent to a desired angle by movement of said roller means.

The present invention thus provides a relatively inexpensive bending tool that may be used to accurately form a blanking tool for cutting carton blanks in the folding carton industry. The device enables a blanking tool of practically any shape to be formed to match the shape of the carton blank.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
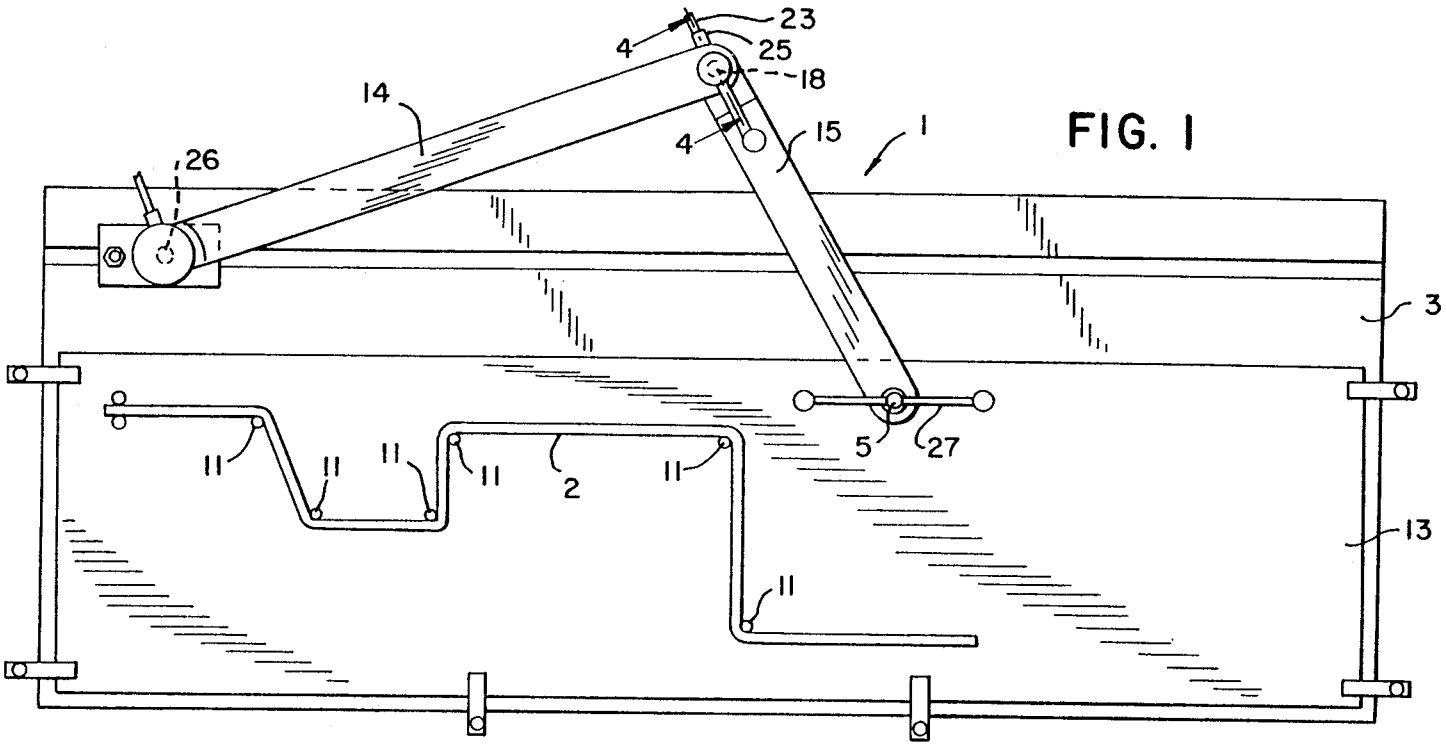
FIG. 1 is a top plan view of a bending device constructed in accordance with the principles of the present invention.
Figure 2:
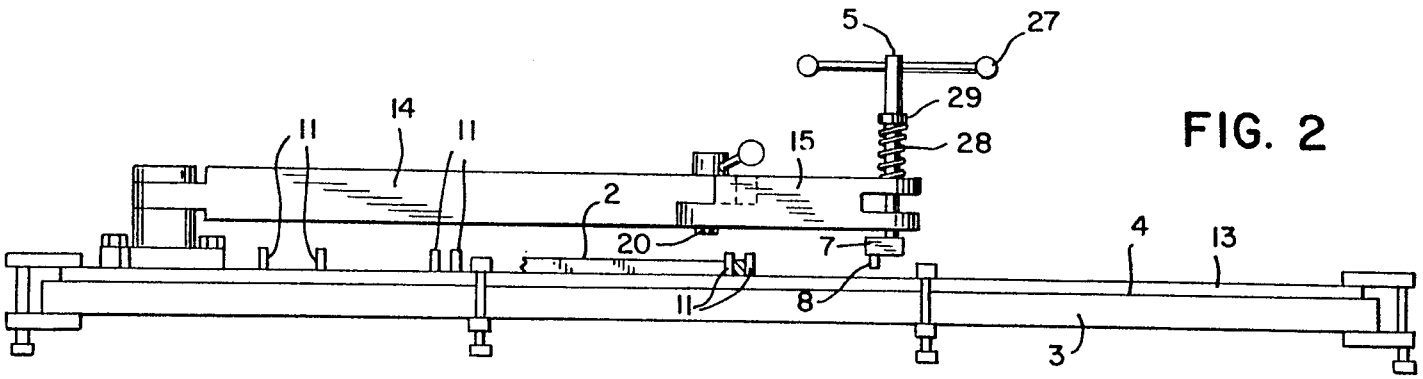
FIG. 2 is a side view in elevation of the bending device of FIG. 1 with the bending tool shown in its nonoperable position.

Referring now to the drawings, FIGS. 1 and 2 illustrate a bending device generally designated by the numeral 1 in accordance with the principles of the present invention. Bending device 1 is utilized for bending a workpiece comprising continuous flat stock material. Workpiece 2 preferably made of steel, and when bent functions as a blanking tool for a die cutter that cuts carton blanks from a continuously fed sheet of cardboard material. The carton blanks are cut into the desired shape so that upon folding may form a particular size and shape carton or container. Thus, bending device 1 is employed to bend workpiece 2 into a variety of different shapes corresponding to the desired carton blank, as will hereinafter be described.

Bending device 1 is mounted on a support member or table 3 which defines a substantially horizontal planar work surface 4. Although illustrated as a table top, work surface 4 may form a part of any type of supporting member having any desired shape and size so long as it is sufficient to support bending device 1 and the consequent forces developed during a bending operation.

Bending device 1 includes an axle member 5 defining a longitudinal axis of rotation 6 about which axle member 5 rotates. Axle member 5 is preferably composed of steel and is orientated with respect to work surface 4 such that a plane passing through rotational axis 6 is perpendicular to work surface 4. Axle member 5 includes an upper end disposed furthest away from work surface 4 and a lower end disposed adjacent work surface 4. The lower end of axle member 5 includes a frame member 7 integrally mounted thereon which in turn mounts a roller member 8 thereon. Roller member 8 projects downwardly from frame 7 and defines a bending axis 9 which is parallel to rotational axis 6 and spaced to one side thereof so that roller member 8 is mounted eccentrically with respect to rotational axis 6.

Figure 3:
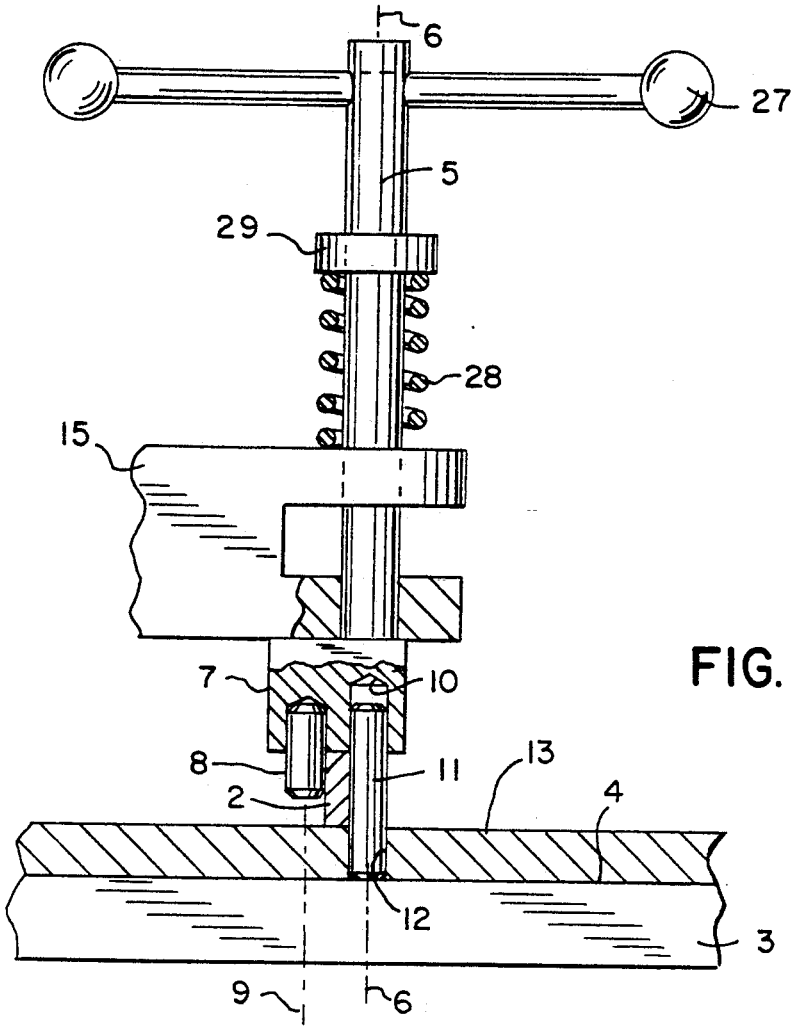
FIG. 3 is an enlarged fragmentary side view illustrating the bending tool in its operable position.

As shown best in FIG. 3, the lower end of axle member 5 also includes a pin receiving bore 10 formed therein located coaxially with the axis of rotation 6. Pin receiving bore 10 cooperates with a plurality of locator pins 11 projecting upwardly from work surface 4 so as to provide a means for properly locating axle member 5 at a bending station which bending station is defined by the location of each pin 11. At each bending station a desired bend is formed in a workpiece 2 to ultimately form the desired shape for a blanking tool. In order to accomplish this, locator pins 11 are removably mounted in one of a plurality of openings 12 formed in a platen 13 mounted on work surface 4 of table 3. Openings 12 in platen 13 form a grid which enables the locator pins 11 to be positioned about work surface 4 until the desired shape for workpiece 2 is formed. Thus, FIG. 1 shows the use of 6 different locating pins 11 each defining an individual bending station at which a particular bend in workpiece 2 is made.

Axle member 5 is mounted for rotation at the outer end of an articulated mounting means. More specifically, the articulated means includes a first arm 14 and a second arm 15 disposed in a horizontal plane above worksurface 2 and parallel thereto. Arm 14 includes an inner end rotatably mounted on table 3 for pivotal movement in a 360° rotation direction. The outer end of arm 14 is pivotally mounted to the inner end of arm 15 and the outer end of arm 15 rotatably mounts axle member 5.

Figure 4:
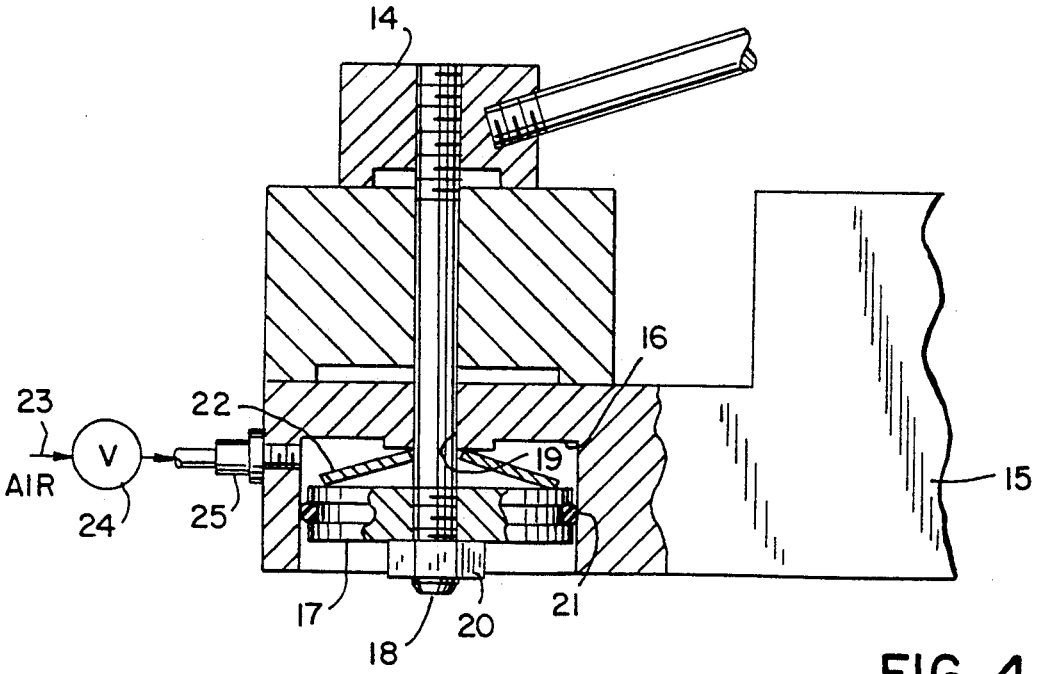
FIG. 4 is a cross-sectional view of one of the clamping pivot connections for the mounting arms of the bending tool.

As shown best in FIG. 4, the pivotal joints or elbows of arm 14 to table 3 and arm 15 to first arm 14 may include pneumatic clamping means for securing arms 14 and 15 as well as axle member 5 in a desired location. As shown in FIG. 4, this clamping means includes an annular chamber 16 formed in the lower face of the inner end of arm 15, and a piston member 17 threadedly mounted on the lower end of a rod 18 passing through a bore 19 formed in the inner end of arm 15. Piston 17 is secured on rod 18 by a nut 20, and the upper end of rod 18 is threadedly secured to the outer end of arm 14. As shown in FIG. 4, the shank of rod 18 thus permits arm 15 to rotate essentially 360° on rod 18 with respect to arm 14 to provide the pivotal connection therefor. Piston 17 is sealed along the outer circumferential surface of chamber 16 by means of an O-ring 21. A spring washer 22 is located about rod 18 between arms 14 and 15, and functions to bias arm 14 away from arm 15 so that arms 14 and 15 are disposed in an unclamped position as shown in FIG. 4. A source of air under pressure passes through a line 23 controlled by a valve 24 and fitting 25 into chamber 16 so that when actuated to a clamped position piston 17 moves downwardly causing arms 14 and 15 to be clamped together against the force of spring washer 22. Arms 14 and 15 thus cannot be moved. Upon the release of air pressure, spring 22 forces 14 and 15 apart permitting movement of arms 14 and 15 with respect to one another. With respect to the inner end of arm 14, its pivotal and clamping connection about rod 26 is identical to that illustrated in FIG. 4 and described above.

The upper end of axle member 5 includes a handle 27 extending radially therethrough which aids in the manual rotation of axle member 5. As shown best in FIG. 3, axle member 5 is not only mounted for rotational movement on the outer end of arm 15 but is also mounted for axial movement with respect thereto. Thus, axle member 5 may be moved between an operable position closely adjacent to work surface 4 and a nonoperable position spaced further away from work surface 4. As a means for biasing axle member 5 in its nonoperable position, bending device 1 includes a coil spring 28 wrapped about axle member 5 and having one end bearing against the upper surface of the outer bifurcated end of arm 15 and its other end bearing against a flange 29 projecting from axle member 5 adjacent the upper end thereof.

In operation, an operator first determines the appropriate desired shape for workpiece 2 to match the desired shape of the blank carton and inserts the appropriate number of locator pins 11 into the openings 12 in platen 13. Each locator pin 11 thus defines a bending station at which a particularly bend will be made in workpiece 2. Thereafter, the operator moves axle member 5 to the locator pin 11 corresponding to the first bend to be made in workpiece 2. When axle member 5 is located above that pin 11, arms 14 and 15 are clamped into position so that they no longer can be moved. Thereafter, the operator manually forces axle member 5 downwardly until locator pin 11 is received within pin receiving bore 10 in axle member 5. At substantially the same time, or immediately prior thereto, the operator insures that workpiece 2 is located adjacent pin 11 and that when axle member 5 is moved downwardly to its operable position, workpiece 2 is positioned between roller member 8 and pin 11, as best shown in FIG. 3. Once axle member 5 is moved to its operable position, it is rotated manually by the use of handle 27 either in a clockwise or counterclockwise direction, whichever is appropriate, and for the appropriate member of degrees, to make the desired bend in workpiece 2. Roller 8 thus cold forms workpiece 2 by bending it around a locator pin 11 as axle member 5 is rotated. Thereafter, downward force on axle member 5 is released and spring 28 forces axle member 5 upwardly away from work surface 4 until locator pin 11 is no longer located within pin receiving bore 10 and roller 8 is located above the upper edge of workpiece 2. The clamping elbows may then be released and axle member 5 moved to the next desired bending station for making another bend in workpiece 2. This procedure is performed step by step until the desired number of bends are made in workpiece 2 so that it corresponds with the desired shape for the blanking tool.

Various modes of carrying out the invention are contemplated as deemed within the scope of the following claims, particularly pointing out and distinctly claiming the subject matter which is regarded as the invention.

I claim:

1. A bending device for forming carton blanking tools from a workpiece comprising:

a support member defining a planar work surface;

an axle member defining a longitudinal axis of rotation and orientated for rotation about said axis in a plane passing through said axis and perpendicular to said work surface;

locator means on said support member defining a plurality of bending stations and cooperable with said axle member to position said axle member at one of said bending stations during a bending operation;

mounting means for mounting said axle member on said support member to permit movement of said axle member to any one of said bending stations, said mounting means comprises an articulated means projecting horizontally over said work surface and disposed in a plane substantially parallel thereto; and roller means mounted eccentrically at one end of said axle member and defining a bending axis parallel to and spaced from said rotational axis so that when said axle member is positioned at a bending station and rotated a workpiece located between said roller means and locator means is bent to a desired angle by movement of said roller means.

2. The bending tool of claim 1 wherein said locator means comprises a plurality of pins projecting upwardly from said work surface cooperable with a pin receiving bore formed in said axle member coaxially with said axis of rotation.

3. The bending tool of claim 1 wherein said articulated means comprises first and second arms each having inner and outer ends wherein the inner end of said first arm is rotatably mounted on said support member and the outer end of said first arm is rotatably mounted to the inner end of said second arm and the outer end of said second arm rotatably mounts said axle member.

4. The bending tool of claim 3 wherein the pivotal connections of said first arm to said support member and to said second arm further includes clamping means for locking said arms in a desired position.

5. The bending tool of claim 1 further including handle means on said axle member for aiding manual rotation of said axle member.

6. A bending device for forming carton blanking tools from a workpiece comprising:

a support member defining a planar work surface;

an axle member defining a longitudinal axis of rotation and orientated for rotation about said axis in a plane passing through said axis and perpendicular to said work surface, wherein the rotational mounting of said axle member also permits axial movement of said axle member between operable and nonoperable positions;

spring means for biasing said axle member in its nonoperable position;

locator means on said support member defining a plurality of bending stations and cooperable with said axle member to position said axle member at one of said bending stations during a bending operation;

mounting means for mounting said axle member on said support member to permit movement of said axle member to any one of said bending stations; and roller means mounted eccentrically at one end of said axle member and defining a bending axis parallel to and spaced from said rotational axis so that when said axle member is positioned at a bending station and rotated a workpiece located between said roller means and locator means is bent to a desired angle by movement of said roller means.

7. The bending tool of claim 6 wherein said spring means comprises a coil spring disposed about said axle member.

* * * * *